United States Patent [19]

Dinger

[11] 4,084,876

[45] Apr. 18, 1978

[54] ELECTRICAL CONNECTOR

[75] Inventor: Leon Joel Dinger, Harrisburg, Pa.

[73] Assignee: AMP Incorporated, Harrisburg, Pa.

[21] Appl. No.: 781,809

[22] Filed: Mar. 28, 1977

Related U.S. Application Data

[63] Continuation-in-part of Ser. No. 622,548, Oct. 15, 1975, abandoned.

[51] Int. Cl.[2] ..... N01R 7/28

[52] U.S. Cl. ..... 339/95 D; 339/217 S

[58] Field of Search ..... 339/95 D, 217 S

[56] References Cited

U.S. PATENT DOCUMENTS

| | | | |
|---|---|---|---|
| 2,720,634 | 10/1955 | Hart | 339/95 D |
| 3,182,281 | 5/1965 | Salz, Sr. | 339/95 D |
| 3,474,389 | 10/1969 | Nagano | 339/95 D |
| 3,609,640 | 9/1971 | Longenecker et al. | 339/217 S X |
| 3,867,004 | 2/1975 | Komorowski | 339/95 D |

FOREIGN PATENT DOCUMENTS

| | | | |
|---|---|---|---|
| 1,800,269 | 5/1970 | Germany | 339/95 D |
| 1,285,589 | 12/1968 | Germany | 339/95 D |

*Primary Examiner*—Roy Lake
*Assistant Examiner*—Howard N. Goldberg
*Attorney, Agent, or Firm*—Allan B. Osborne

[57] ABSTRACT

The present invention relates to a connector for splicing or interconnecting two electrical wires together without the use of crimping tools or solder. More particularly the invention includes an insulated housing having a through passageway and a spring member positioned in the passageway. The spring member contains two free ends doubled back on themselves to provide locking and terminating means for the wires entering the housing and the apertures in the spring member.

1 Claim, 8 Drawing Figures

ELECTRICAL CONNECTOR

CROSS REFERENCE TO RELATED APPLICATION

This application is a continuation-in-part application of U.S. application Ser. No. 622,548, filed Oct. 15, 1975, and now abandoned.

BACKGROUND OF THE INVENTION

1. Field of the Invention

The splicing or electrically joining of two wires by employing the "Chinese finger" concept.

2. Description of the Prior Art

Electrical connectors of the type having a spring member within an insulating housing is well known in the industry. Wiremold Company of West Hartford, Connecticut has been selling a successful connector for a number of years. Examples of this type connector are found in U.S. Pat. Nos. 3,474,389; 3,569,911 and 3,671,924.

SUMMARY OF THE INVENTION

The present invention provides a housing of insulating material having a single passageway extending longitudinally therethrough. Stop means are provided adjacent each end of the passageway. A spring member having its free ends formed back on themselves are positioned in the passageway with a pair of outwardly projecting tines bearing against the stop means to secure the spring member in the housing. The spring member has a pair of fingers extending obliquely towards the floor. Wires entering the housing are terminated and retained therein by being trapped between the free ends of the fingers and the floor.

The principle object of this invention is to provide an electrical connector wherein the spring member holds the wires against high tensile forces.

Another object of this invention is to provide an electrical connector of two components which is economical to manufacture.

Still another object of this invention is to provide an electrical connector which does not require the use of crimping tools or solder.

Yet another object of this invention is to provide an electrical connector which is simple to use and is foolproof.

These and other objects of this invention will become manifest upon reading the following description in conjunction with the accompanying drawings.

DESCRIPTION OF THE PRESENT INVENTION

Figure 1:
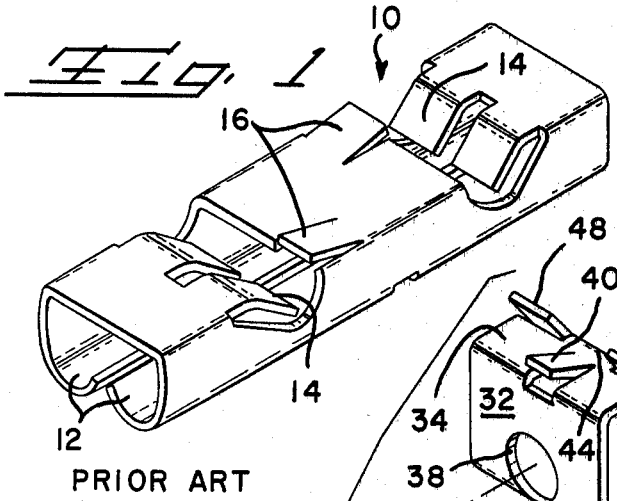
FIG. 1 is a perspective view of the spring member of a prior art electrical connector.

FIG. 1 illustrates a prior art spring member 10. This spring member, capable of connecting four wires together, has two parallel arcuate floors 12 which receive the wires (not shown), fingers 14 which trap the wires from being pulled back out of the member, and a pair of tines 16 which secure the members in an insulating housing (not shown). Wire stops are present on the floor but cannot be seen in the drawing.

Figure 2:
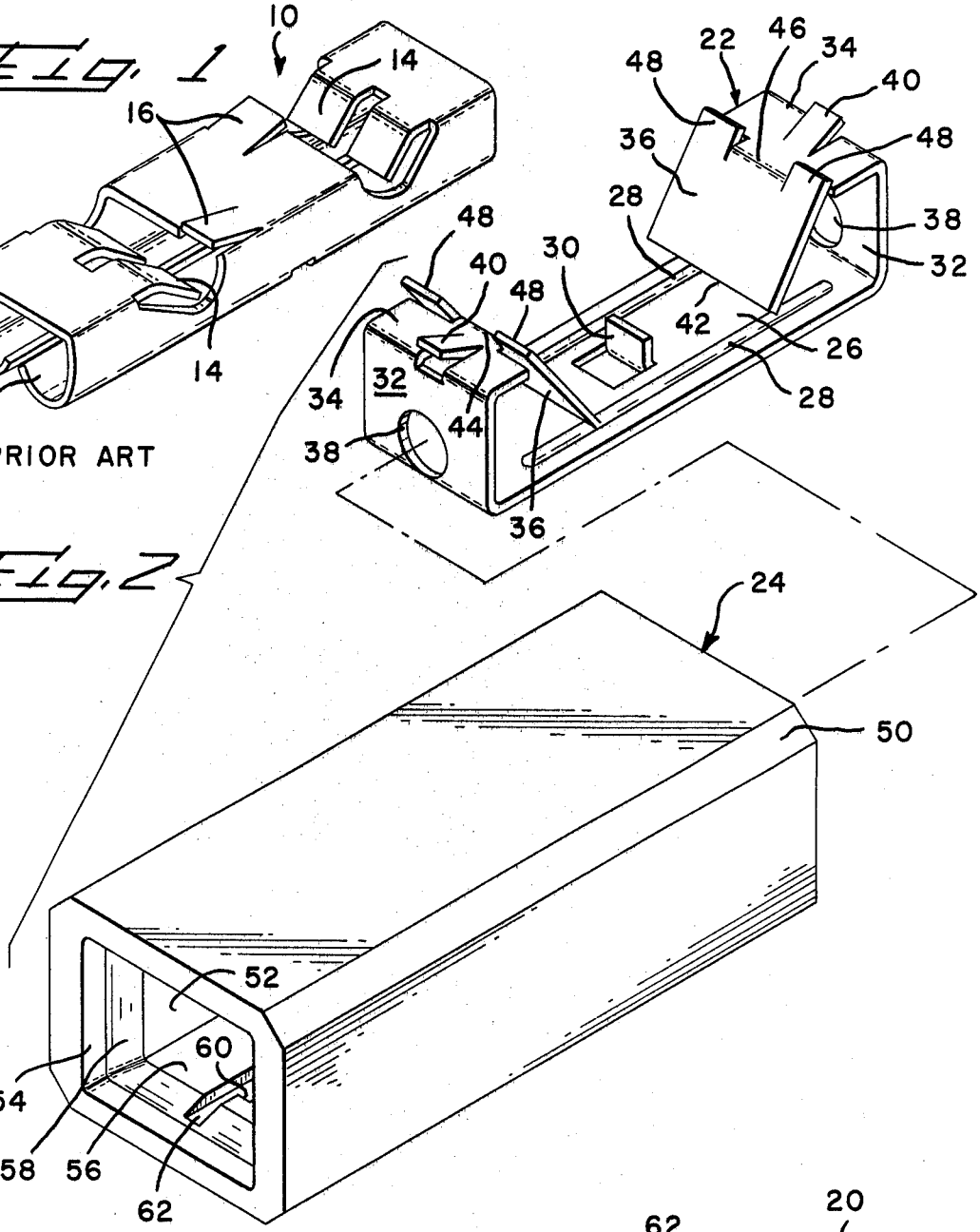
FIG. 2 is an exploded perspective view of the two components comprising the electrical connector constructed in accordance with one embodiment of the present invention.
Figure 3:
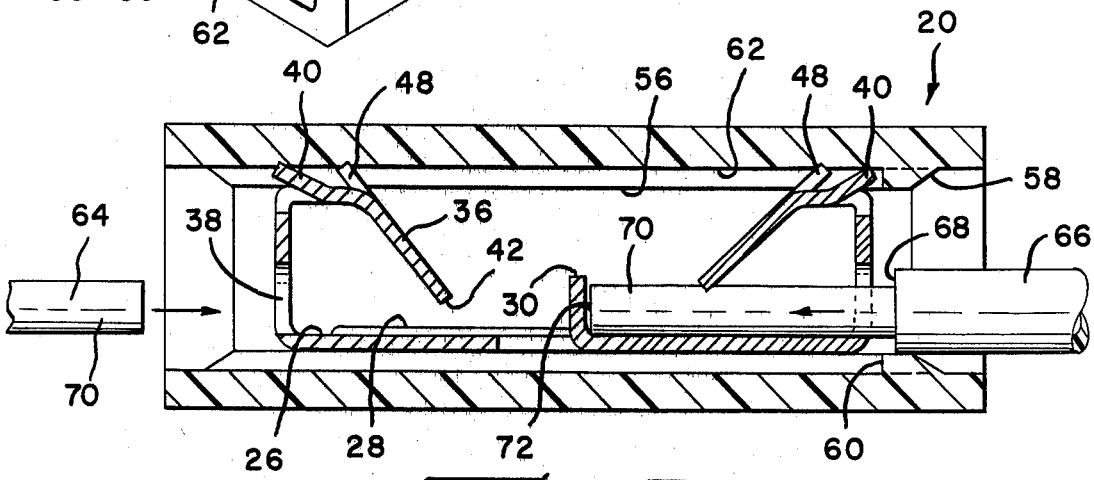
FIG. 3 is a cross-sectional elevational view of the electrical connector of FIG. 2 post-assembly and as utilized.

The electrical connector 20 of the present invention, illustrated in exploded fashion in FIG. 2 and in assembled fashion in FIG. 3, consists of two components: the spring member 22 and the housing 24.

Spring member 22 is unitary and is preferably stamped and formed from a coplanar sheet of beryllium copper. The elongated floor 26 of the spring member is ribbed, indicated by reference numerals 28, along both sides to provide strength against longitudinal bowing. A wire stop 30 is blanked out and formed vertically from the floor.

The two ends of the material from which spring member 22 is made is formed up, inwardly on a horizontal plane and downwardly on an oblique plane to provide respectively vertical walls 32, horizontal sections 34 and fingers 36.

The vertical walls 32 each contain an aperture 38 the lower part of which is on level with floor 26 as can be seen in FIG. 3. The aperture is preferably centered in the wall so as to be in direct alignment with wire stop 30.

The horizontal sections 34 contain a tine 40 which is balnked out from the sections to project up and out; i.e., at an oblique angle relative to the horizontal section.

Fingers 36 have a free end 42 which is spaced close to floor 26. The finger is attached at an opposite end 44 to the inside edge of horizontal section 34 by an integral hinge member 46. The hinge which is about one-half the width of the spring member, provides limited mobility to the fingers; i.e., the fingers can move in an arc about the hinge.

Each finger 36 has as part of the opposite end 44 a pair of tines 48, one on either side of the hinge. These tines point away from the finger's free end 42 and are in the same plane as the finger proper.

Housing 24 may be molded from insulating material such as a nylon marketed by E. I. DuPont De Nemours & Co. under the tradename Zytel-101. The length of the housing preferably exceeds the length of the spring member 22 as FIG. 3 indicates. The edges of the outer surface of the housing may be beveled as indicated by reference numeral 50.

Referring now to both FIGS. 2 and 3, a passageway 52 extends through the housing with entrances or openings 54 on either end. The passageway is reduced in size inwardly from openings 54. The reduction provides a beveled step 58 on each wall 56. Inwardly from the steps and on the two horizontal walls only are stop means or shoulders 60 facing inwardly along the longitudinal axis of the housing; i.e., toward each other. The groove 62 seen in the drawings are grooves left by the core-pin (not shown) used in forming shoulders 60 during the molding operation.

To assemble the two components 22 and 24 into electrical connector 20 as shown in FIG. 3, it is only necessary to orientate the spring member 22 with respect to the shoulder-containing walls and push the member into passageway 52 via an opening 54. Pushing is continued until resistance thereto is met. Such resistance is caused by a tine 40 abutting up against a shoulder 60. The distance between shoulders 60 equal the distance between tines 40 so that both tines abut the respective shoulders simultaneously. The spring member is now locked into the passageway against longitudinal movement in either direction. The shoulders 60 on the opposite horizontal wall are provided to simplify orientation of the spring member and housing in the assembly. As is apparent, only one set of shoulders 60 are necessary.

Two wires 64 and 66, shown in FIG. 3, are spliced together by first removing a length of the outer insulating jacket 68 from conductor 70. The bared conductor is now pushed into the spring member through aperture 38 and in between the floor 26 and free end 42 of finger 36 until the conductor end 72 abuts wire stop 30. Wire 66 in FIG. 3 is now trapped; i.e., it cannot be withdrawn from the connector 20. As withdrawing forces are applied to the wire, the tines 48 on finger 36 dig into the housing. The short length of the finger and the tines digging into the housing cooperate to prevent the finger from bowing, the consequence of which would permit the wire to be withdrawn. The free end of the finger is concurrently digging into conductor 70. Ribs 28 on the floor 26 prevent the floor from bowing upwardly under tensile forces. Clearly a spring member having a bowed floor would not hold a wire therein. To complete the splice the bared conductor 70 of wire 64 is pushed into the spring member through the aperture at the opposite end of the housing.

Figure 4:
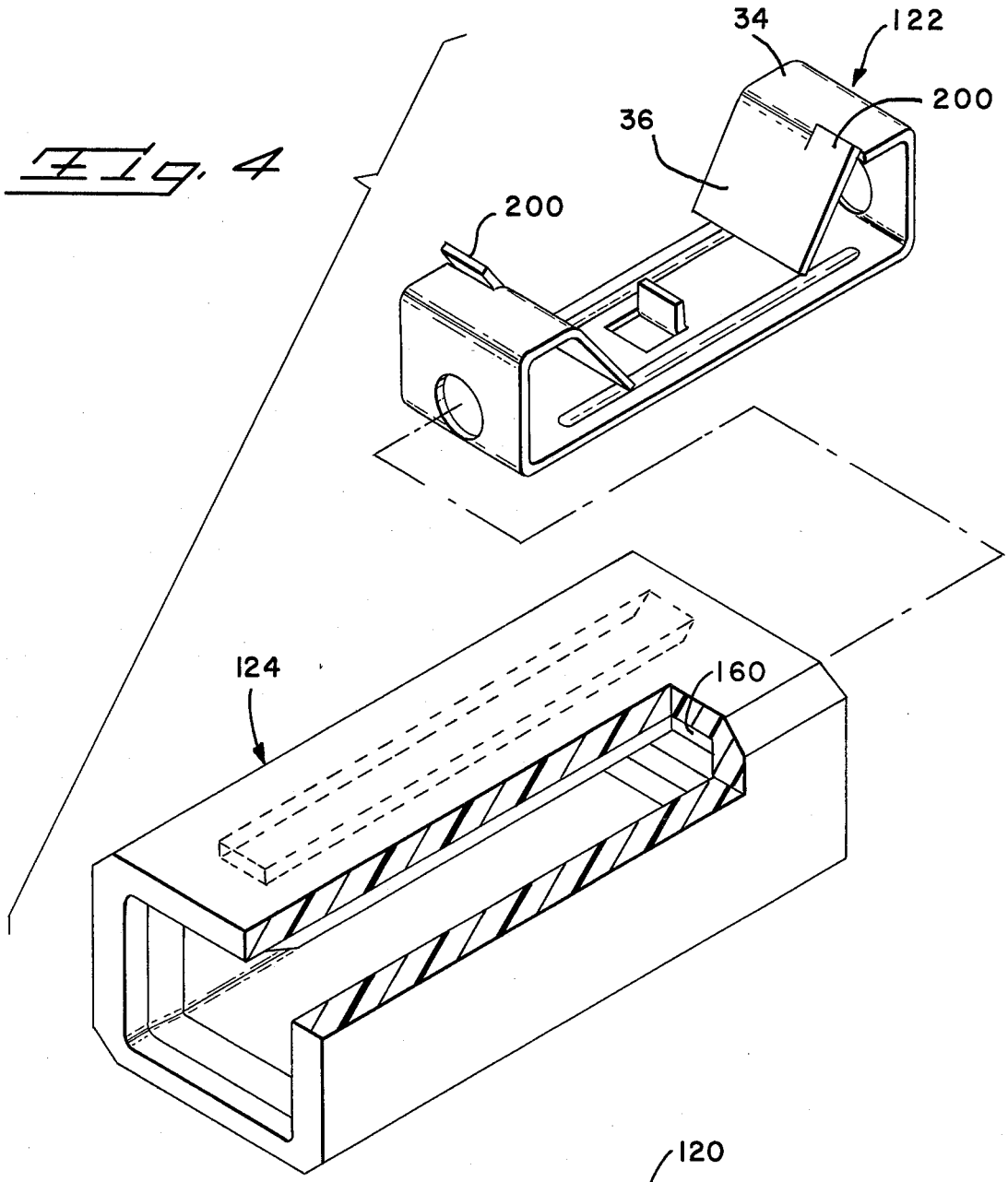
FIG. 4 is an exploded perspective view of the two components comprising the electrical connector constructed in accordance with another embodiment of the present invention.

FIG. 4 shows the two components of another embodiment. Spring member 122 differs in one respect from spring member 22. Whereas spring member 22 has a tine 40 on horizontal section 34 and two tines 48 on finger 36, spring member 122 combines the functions of the three tines into one tine 200.

Housing 124 is nearly identical to housing 24. The one difference is that the tine stop or shoulder 160 is offset laterally from the center of the horizontal wall. This modification is required to receive the offset tine 200 or spring member 122.

Figure 5:
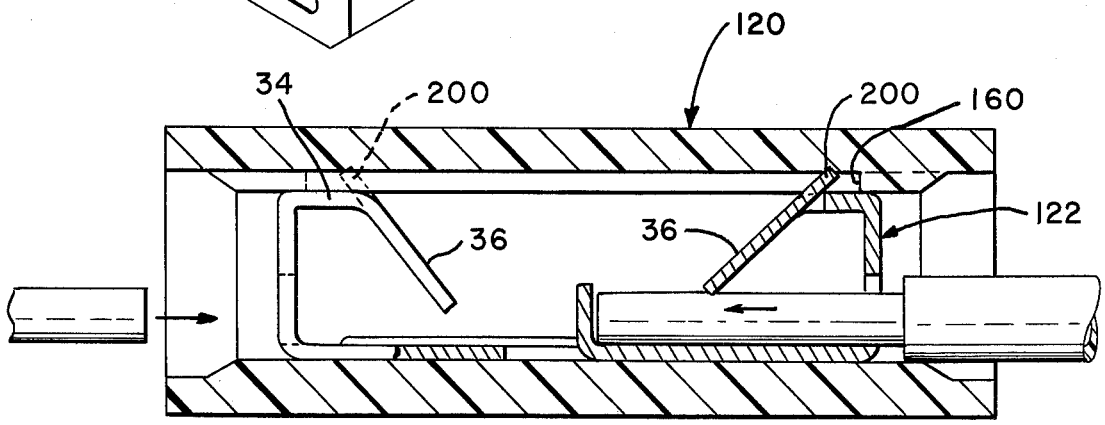
FIG. 5 is a cross-sectional, elevational view of the electrical connector of FIG. 4 post-assembly and as utilized.

The assembly and use of electrical connector 120 is shown in FIG. 5 and as is apparent therefrom is the same as shown and described for connector 20.

Figure 6:
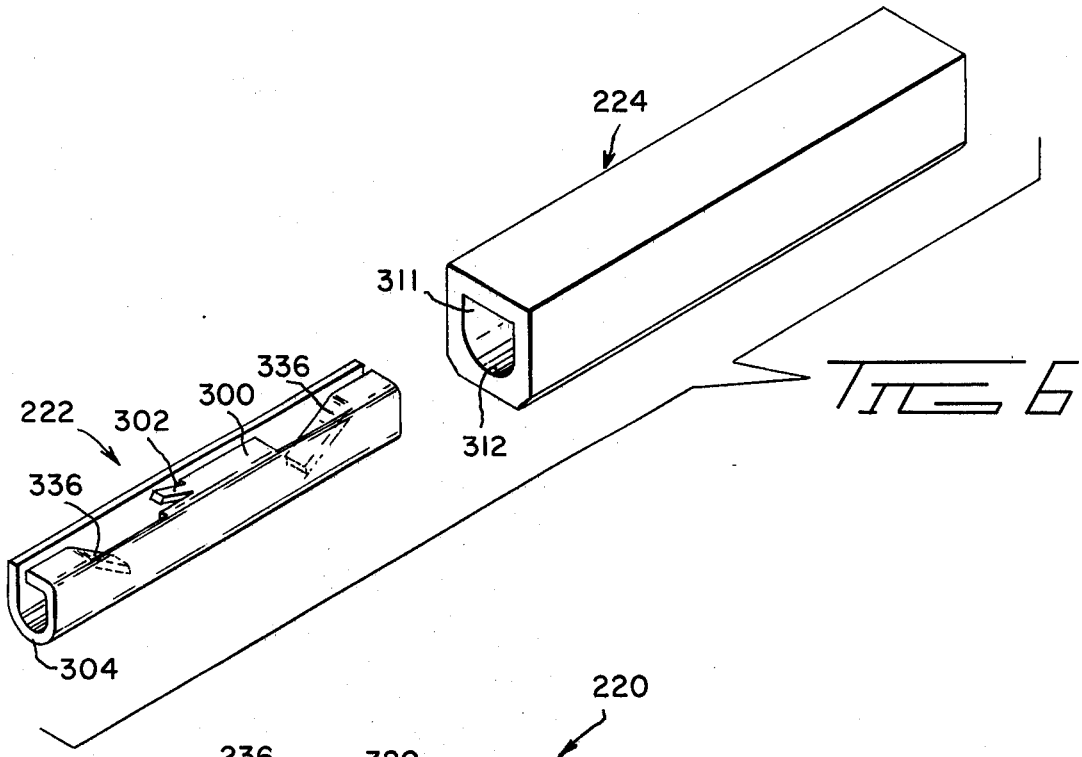
FIG. 6 is an exploded perspective view of the two components comprising the preferred embodiment of the electrical connector.

FIG. 6 shows the two components of the preferred embodiment. As is apparent, noticeable differences exist.

Figure 7:
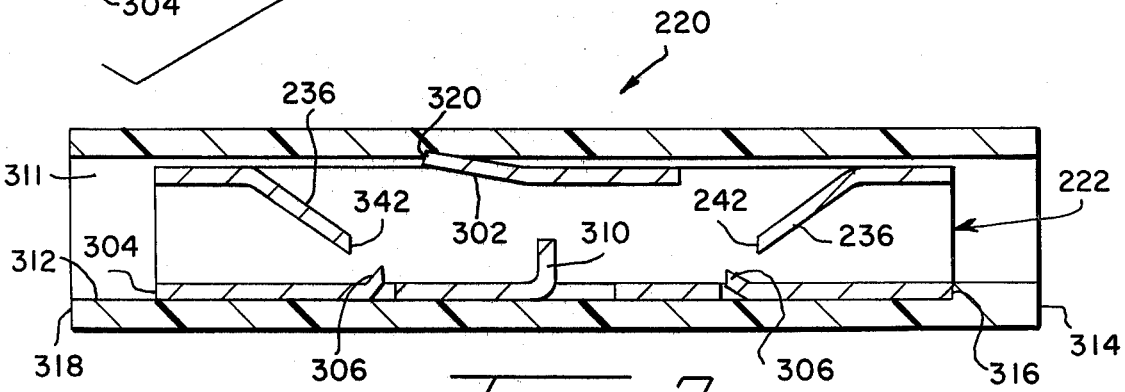
FIG. 7 is a cross-sectional, elevational view of the electrical connector of FIG. 6 after the two components have been assembled.

With reference to FIGS. 6 and 7, spring member 222 is stamped and formed from a coplanr sheet of conductive material, preferably beryllium copper. Along one edge 300, two tines or fingers 236 are provided. These fingers are bent down so that the free ends 242 face each other and toward the opposite side of the member. A third tine 302 is blanked out between fingers 236 and is bent obliquely outwardly.

On the rounded side 304, opposing fingers 236, a pair of stub tines 306 are blanked out and bent inwardly. Their free ends 324 are preferably inside the free ends 242 of fingers 236. Intermediate the stub tines a wire stop 310 is provided.

Housing 224, molded from nylon or other insulative materials, has a length greater than that of the spring member. It contains a passageway 311 having a cross-sectional shape similar to the spring member; i.e., three flat sides and one rounded side 312. Near one end 314 of the housing a step 316 is provided on the wall of side 312. The step reduces the size of the passageway at end 314.

Assembly of the two components requires the proper orientation; i.e., aligning rounded side 304 with rounded side 312 and inserting the spring member into end 318 with the free end 320 of tine 302 pointing away from the housing. The spring member is pushed into the passageway until one end abuts against step 316. The member is now locked into the passageway by step 316 and by the free end 320 of tine 302 digging into the wall if a rearward force is applied.

Figure 8:
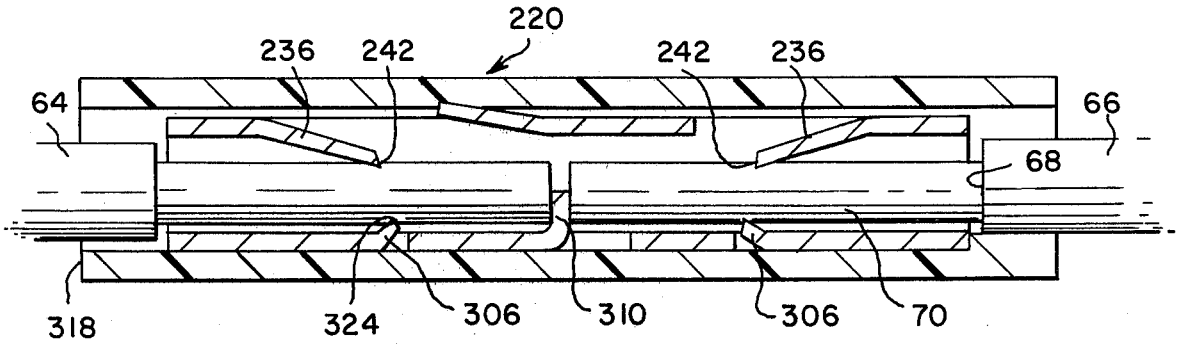
FIG. 8 is the same view as FIG. 7 but subsequent to a pair of wires being electrically connected in the connector.

Two wires 64 and 66 are spliced together by first removing the outer insulating jacket 68 from around conductor 70. The bared conductor is pushed into either end of the spring member via passageway 311. As FIG. 8 shows, the conductors are pushed in between the ends of fingers 236 and stub tines 306 and abut against stop 310. The wires are trapped in the connector 220 by the free ends 242 on fingers 236 and free ends 324 on stub tines 306. In addition to providing retention forces, the combined effect of fingers 236 and stub tines 306 increase the electrical contact area between the conductors and spring members.

The foregoing detailed description has been given for clearness of understanding only, and no unnecessary limitations should be understood therefrom, as some modifications will be obvious to those skilled in the art.

What is claimed is:

1. An electrical connector for electrically splicing two conductors together, comprising:

a. an elongated housing of insulating material having a passageway therethru; and b. a coplanar strip of conductive material formed into an elongated, tube-like spring member with a flat top wall, an arcuate bottom wall and a passage therethru with a conductor-receiving opening at each end, a finger near each opening extending obliquely into the passage from the top wall with the free end pointing generally toward the opposite opening, said spring member further including a tine near each opening extending obliquely into the passage from the lower wall with the free end pointing generally towards the opposite opening, said spring member being positioned in the housing passageway and adapted to electrically connect two conductors which may be inserted into the openings and to retain said conductors against withdrawal by said fingers and tines gripping the conductors.

* * * * *